US005996742A

United States Patent [19]

Aulanko et al.

[11] Patent Number: 5,996,742

[45] **Date of Patent: *Dec. 7, 1999**

[54] ELEVATOR MACHINERY

[75] Inventors: Esko Aulanko, Kerava; Harri Hakala; Jorma Mustalahti, both of Hyvinkää, all of Finland

[73] Assignee: Kone Oy, Helsinki, Finland

[ * ] Notice: This patent issued on a continued prosecution application filed under 37 CFR 1.53(d), and is subject to the twenty year patent term provisions of 35 U.S.C. 154(a)(2).

[21] Appl. No.: 08/969,711

[22] Filed: Nov. 20, 1997

Related U.S. Application Data

[63] Continuation of application No. 08/571,834, filed as application No. PCT/FI94/00285, Jun. 23, 1994, abandoned.

[30] Foreign Application Priority Data

| | | | |
|---|---|---|---|
| Jun. 28, 1993 | [FI] | Finland | 932976 |
| Dec. 28, 1993 | [FI] | Finland | 935908 |
| Apr. 7, 1994 | [FI] | Finland | 941599 |

[51] Int. Cl.[6] ..... B66B 11/08

[52] U.S. Cl. ..... 187/254; 187/266

[58] Field of Search ..... 187/254, 264, 187/266, 350, 362, 378

[56] References Cited

U.S. PATENT DOCUMENTS

| | | | |
|---|---|---|---|
| 2,088,690 | 8/1937 | Crispen | 187/20 |
| 3,101,130 | 8/1963 | Bianca | 187/20 |
| 3,500,083 | 3/1970 | Dochterman | 310/51 |
| 4,361,776 | 11/1982 | Hayashi et al. | 310/268 |
| 4,664,230 | 5/1987 | Olsen | 187/39 |
| 4,739,969 | 4/1988 | Eckersley et al. | 254/378 |
| 4,771,197 | 9/1988 | Ivanto et al. | 310/67 R |
| 4,814,654 | 3/1989 | Gerfast | 310/154 |
| 4,823,039 | 4/1989 | Lynch | 310/268 |
| 4,960,186 | 10/1990 | Honda | 187/254 |
| 4,978,878 | 12/1990 | Dijken | 310/268 |
| 4,987,333 | 1/1991 | Noguchi et al. | 310/268 |
| 5,018,603 | 5/1991 | Ito | 187/254 |
| 5,024,162 | 6/1991 | Nigg et al. | 104/178 |
| 5,062,501 | 11/1991 | Pavoz et al. | 187/112 |
| 5,079,461 | 1/1992 | Schluter et al. | 310/67 A |
| 5,128,571 | 7/1992 | Itsu | 310/67 R |
| 5,140,212 | 8/1992 | Iwasaki et al. | 310/191 |
| 5,142,181 | 8/1992 | Newell | 310/268 |
| 5,144,183 | 9/1992 | Farrenkopf | 310/268 |
| 5,146,144 | 9/1992 | Lee | 318/138 |
| 5,289,069 | 2/1994 | Hasegawa et al. | 310/156 |
| 5,334,899 | 8/1994 | Skybyk | 310/268 |
| 5,396,134 | 3/1995 | Mochizuki | 310/67 R |
| 5,397,953 | 3/1995 | Cho | 310/254 |
| 5,440,185 | 8/1995 | Allwine, Jr. | 310/156 |
| 5,455,474 | 10/1995 | Flynn | 310/181 |
| 5,475,274 | 12/1995 | Katakura | 310/67 R |
| 5,493,161 | 2/1996 | Uno et al. | 310/156 |
| 5,495,131 | 2/1996 | Goldie et al. | 310/12 |

FOREIGN PATENT DOCUMENTS

| | | |
|---|---|---|
| 2127873 | 7/1993 | Canada . |
| 51802 | 12/1976 | Finland . |
| 1575459 | 7/1969 | France . |
| 2058803 | 6/1972 | Germany . |
| 4-50297 | 8/1963 | Japan . |
| 63-119579 | 8/1988 | Japan . |
| 2-309066 | 12/1990 | Japan . |
| 3-283142 | 12/1991 | Japan . |
| 1485305 | 9/1977 | United Kingdom . |

*Primary Examiner*—Kenneth Noland

[57] ABSTRACT

The stator disc (11) of a disc motor type elevator machinery has a cuplike or ring-shaped annular cavity (20). The stator (9) is attached to one of the walls of the cavity. The traction sheave (4) is attached to the rotor disc (14) on the opposite side relative to the stator core packet (12) of stampings. The diameter of the traction sheave is smaller than that of the stator core packet (12). A sealing (24) is provided between at least one (22) of the cavity (20) walls and the rotor disc (14) to block the access of external particles into the rotor and stator.

46 Claims, 4 Drawing Sheets

ELEVATOR MACHINERY

This application is a continuation, of application Ser. No. 08/571,834 filed on Mar. 19, 1996 now abandoned filed as PCT application PCT/F194/00285 on Jun. 23, 1994, the entire contents of which are incorporated herein by reference.

The present invention relates to an elevator machinery including an elevator motor having a stator disc with a stator core packet of stampings with stator windings; a rotor disc with a rotor excitation system attached to the rotor disc in an area opposite to the stator core packet, an air gap betweeen the excitation system and the stator core packet forming a plane substantially perpendicular to the motor shaft or forming a core whose mid-line coincides with the mid-line of the shaft.

The physical dimensions of an elevator machinery affect the size of the elevator shaft and/or the building itself, depending on where the machinery is located. When the machinery is placed in or beside the elevator shaft or in a machine room, the thickness of the machinery has an importance with respect to the space required.

A conventional elevator machinery comprises a separate motor, a gear system and a traction sheave. A conventional elevator machinery is well suited for installation in a machine room where a sufficient space has been reserved for the machinery. Previously known are also solutions where such a machinery is placed in the counterweight or beside the elevator shaft. The space required by the elevator machinery is a significant cost factor.

An elevator machinery can also be implemented as a gearless system, based on a disc-type motor. An elevator motor of this type is presented e.g. in FIG. 8 of patent publication U.S. Pat No. 5,018,603. The motors described in the publication are clearly more compact and flatter in the lengthwise direction of the motor shaft than conventional geared elevator machineries. However, the machineries presented in the publication are clearly designed for installation in a machine room. The elevator machinery described in the publication can also be placed in the counterweight. The cross-sectional area of the counterweight required by the machinery is smaller than in the case of an elevator machinery provided with a separate gear, but it is still large.

In addition, previously known elevator machineries based on a gearless disc-type motor have other defects. They have a relatively low force acting on the ropes, because the traction sheave is the outermost part of the machinery. The same motor is not directly applicable for installation in different places, e.g. in a machine room, in the shaft or in the counterweight. In known elevator machineries, detrimental particles, such as ferromagnetic dust, may gather in the space of the stator and rotor windings. Furthermore, previously known elevator machineries based on a disc-type motor have the disadvantage that if the machinery is to have a larger lifting power, its diameter has to be increased, which also means increasing the diameter of the traction sheave. Therefore, the increase in lifting power obtained by increasing the motor diameter cannot be fully utilized.

The object of the present invention is to produce a new is construction for an elevator machinery based on a disc-type motor, designed to give better operating and perfomance characteristics than previously known elevator machineries based on a disc-type motor.

The invention has the advantage that it permits a larger range of variation of the diameter of the traction sheave than in elevator machineries built according to previously known technology. The desired elevator speed and the required tractive force of the ropes can be achieved economically.

An embodiment of the invention has the advantage that the force applied by the elevator machinery to the elevator ropes is larger than in corresponding known elevator machineries, which is due to the fact that the diameter of the traction sheave in an elevator machinery implemented according to this embodiment is smaller than the outer diameter of the stator core packet of stampings. The elevating capacity can be varied within a larger range just by changing the diameter of the traction sheave, which is not possible in corresponding previously known elevator machineries, in which the stator diameter has to be changed as well.

An elevator machinery according to another embodiment, having the same basic structure, is suited for installation e.g. in the counterweight, machine room or elevator shaft. This property has been achieved by providing the stator of the elevator machinery with points of attachment that allow the same basic machinery to be fixed to various supporting elements, such as a counterweight side plate or a guide rail of the elevator or counterweight.

In another embodiment, the access of detrimental particles into the winding space of the elevator motor is blocked by placing a sealing between the rotor and stator discs. The rotor disc has a ringlike extension which is provided with a sealing face outside the circle formed by the stator and rotor windings. In this way, the winding space remains clean, permitting longer maintenance intervals of the motor.

In a further embodiment, the elevator machinery is implemented as a flat and compact structure. In the case of this elevator machinery, one cannot directly tell which part of it belongs to the elevator machinery and which part belongs to the elevator motor, because the elevator machinery is actually built around the elevator motor. The flat construction of the elevator machinery provides a great advantage when the machinery is installed in a machine room, in the counterweight of the elevator or in the elevator shaft.

A further embodiment of the invention has the advantage that the parts of the elevator machinery can easily be intergrated. Thus, the rotor disc can be manufactured as a homogeneous single body containing a rotor disc, a sealing face, a braking surface and a tract ion sheave. Similarly, the stator disc can be manufactured as a single body comprising a space for the stator winding, a fixing surface for a sealing and fixing elements for the motor shaft and elevator machinery.

BRIEF DESCRIPTION OF THE DRAWINGS

The invention is described by the aid of two embodiments, in which.

DETAILED DESCRIPTION OF THE PREFERRED EMBODIMENTS

Figure 1:
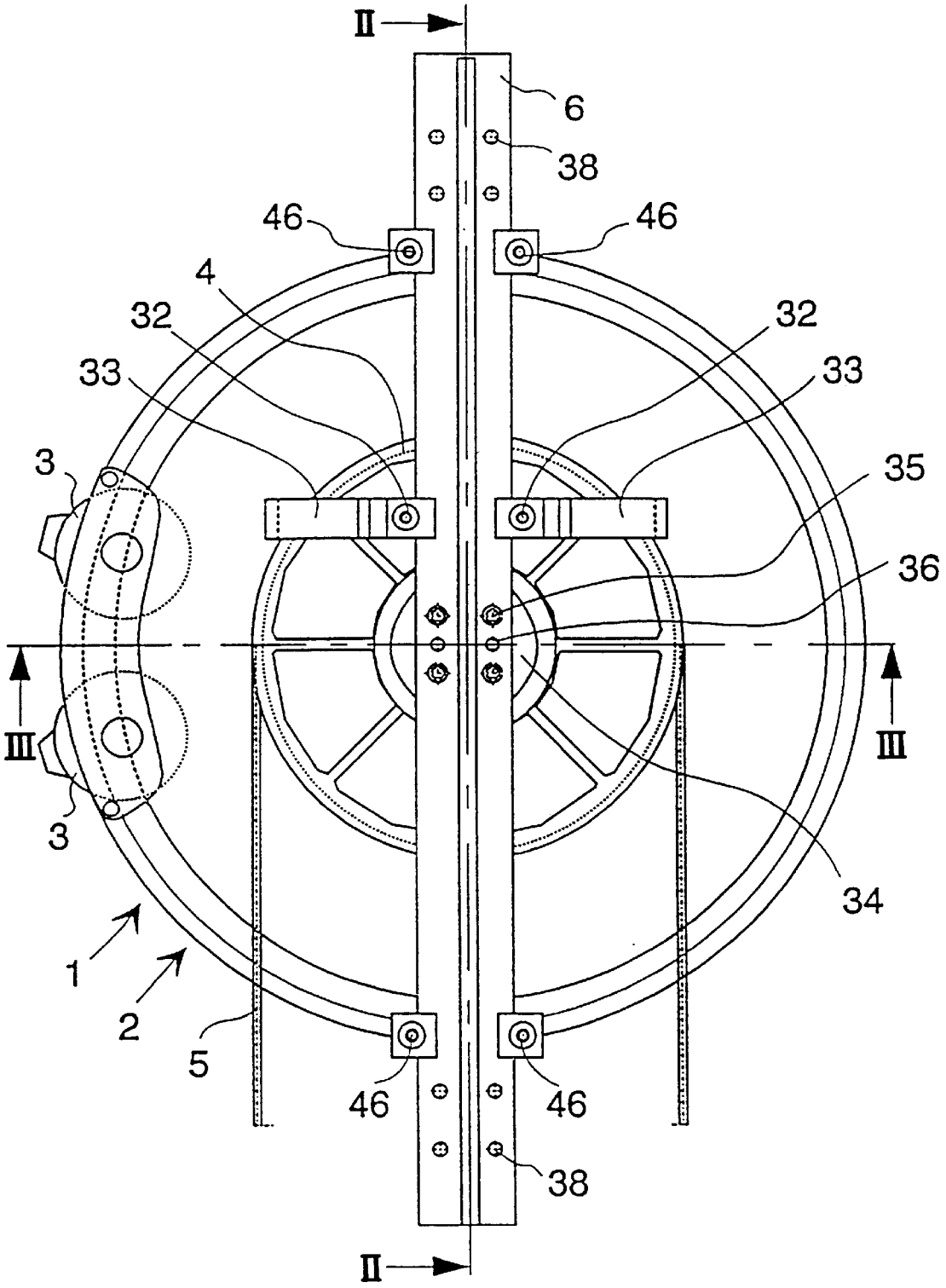
FIG. 1 presents an elevator machinery according to the invention, seen from the direction of the shaft.

FIG. 1 shows a gearless elevator machinery 1 according to the invention, mounted on a guide rail 6. The elevator machinery 1 has a disc-type elevator motor 2, a brake 3 and a traction sheave 4. The elevator ropes 5 are passed around the traction sheave 4. The elevator machinery is attached to a guide rail 6 of the elevator (or counterweight) by means of mounting fixtures 46 placed on opposite sides of the rail and holding the machinery by the edge of the stator, and other fixtures 35 holding the elevator machinery by its middle part. The vertical forces of the elevator machinery are transmitted via shear bolts 36 to the guide rail 6. Attached with fixtures 32 to the guide rail 6 is also a protector 33 designed to prevent the elevator ropes 5 from coming off the rope grooves 19.

Figure 2:
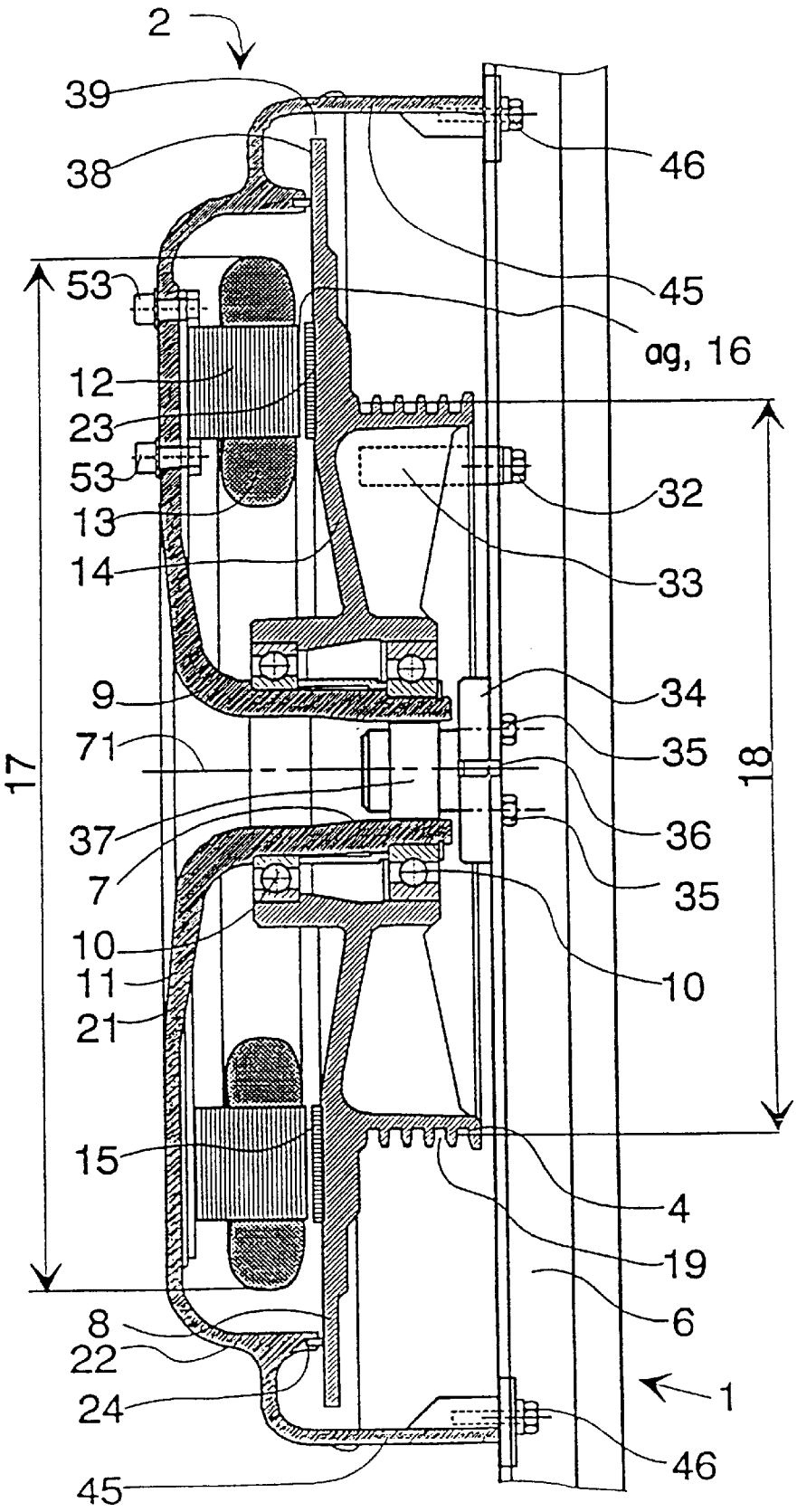
FIG. 2 presents a cross-section of the elevator machinery.

FIG. 2 presents the elevator machinery 1 of FIG. 1 as sectioned along line II—II. The elevator machinery I comprises an elevator motor 2, a traction sheave 4 driving the elevator ropes 5, and a brake 3. The elevator motor comprises a stator 9, a shaft 7 and a rotor 8 and a bearing 10 between the rotor 8 and the stator 9. The stator 9 consists of a stator disc 11 having a ring-shaped stator core packet of stampings 12 and a stator winding 13. The stator core packet 12 with the stator winding is attached with fixtures 53 to the stator disc 11. The fixtures 53 are preferably screws. The rotor consists of a rotor disc 14, with the rotor excitation system 15 attached to the rotor disc opposite to the stator core packet 12. The excitation system 15 has been formed by attaching to the rotor disc 8 a number of permanent-magnets 23 in succession so as to form a ring-shaped circle. The attachment is preferably made by glueing. The magnetic flux of the rotor passes via the rotor disc. The part of the rotor disc which lies under the permanent magnets forms part of the magnetic circuit and acts as a part contributing to the material strength of the rotor. The permanent magnets may be different in shape and they can be divided into smaller magnets placed side by side or in succession.

Between the permanent magnets 23 and the stator core packet 12 there is an air gap ag which forms a plane 16 essentially perpendicular to the shaft 7. The air gap ag may also have a slightly conical shape (not shown in the figure). In this case the mid-line of the cone coincides with the mid-line 71 of the shaft 7. The traction sheave 4 and the stator 9 are placed on different sides of the rotor disc 14 in the direction of the shaft 7 of the elevator motor 2.

The elevator motor 2 may be e.g. a synchronous motor or a commutating d.c. motor.

The traction sheave 4 forms an integrated structure with the rotor disc 14 and the shaft 7 is integrated with the stator disc 11, but both could just as well be separate parts. However, an integrated structure is preferable with regard to manufacturing technology. The elevator machinery is mounted on tile guide rail 6 by means of a carrier pin 34 fixed to the rail with screws 35. The screws carry the axial loads of the elevator machinery. Between the carrier pin and the guide rail there are also shear bolts 36 (2 pcs) which receive the vertical loads. The shaft 7 is hollow and the end of the carrier pin is inside the hollow shaft. The carrier pin is provided with a relatively narrow annular boss 37 of about 10 mm, placed in alignment with the focus of the rope load of the elevator and at the same time with one of the bearings 10. The machinery can slightly turn horizontally about the boss 37. This arrangement provides the advantage that the guide rail need not be so fixed that it is completely rigid in the region of the machinery, but it suffices for the retainment of the guide rail to fix it on both sides of the machinery by means of supporting elements 38 is (FIG. 1), and the guide rail still functions as a component bracing the elevator machinery in regard of material strength.

The stator disc 11 is provided with a cuplike or ring-shaped troughlike cavity 20 formed by a first wall 21 and a second wall 22 joined together, leaving the cavity open on one side. The first wall 21 is attached to the shaft 7. The stator core packet 12 with the stator winding 13 is attached to the first wall by means of fixing elements 53. The second wall 22 is directed towards the rotor disc 14.

The elevator machinery of the invention can also be implemented as an embodiment having a stator disc 11 provided with a cuplike or ring-shaped annular cavity 20 open on one side and formed by a first wall 21 and a second wall 22 joined together, both walls being directed towards the rotor disc 14. The first wall 21 is attached to the shaft 7 by means of bracing ribs and the stator core packet 12 with the stator winding 13 is attached either to the first or the second wall. This second embodiment is suited for elevator motors having a very large diameter. This second embodiment is not shown in the figures because the above description is sufficient for a person skilled in the art.

Mounted between the rotor disc 8 and the second wall 22 directed towards the rotor disc 8 is a sealing 24, which may be a felt gasket, a lap seal or some other type of sealing, e.g. a labyrinth seal. The labyrinth seal may be implemented e.g. by providing the rotor disc 14 with a ridge in the sealing zone and the stator disc with collet-shaped ridges placed in a corresponding location on either side of the first ridge. The sealing prevents detrimental particles from getting into the cavity.

The rotor disc is provided with a brake disc 38 for a disc brake, forming an extension of the top circle of the rotor disc. The brake 3 may also be a shoe brake, in which case the braking surface is the outermost part 39 of the annular brake disc. Thus, the brake disc is substantially an immediate extension of the rotor disc, yet with a narrow annular area for a sealing betweeen the rotor bars and the brake disc.

Moreover, the elevator machinery is provided with an outermost wall 40 which extends over the brake disc and forms a baffle plate shielding the brake plate e.g. from being touched.

Figure 3:
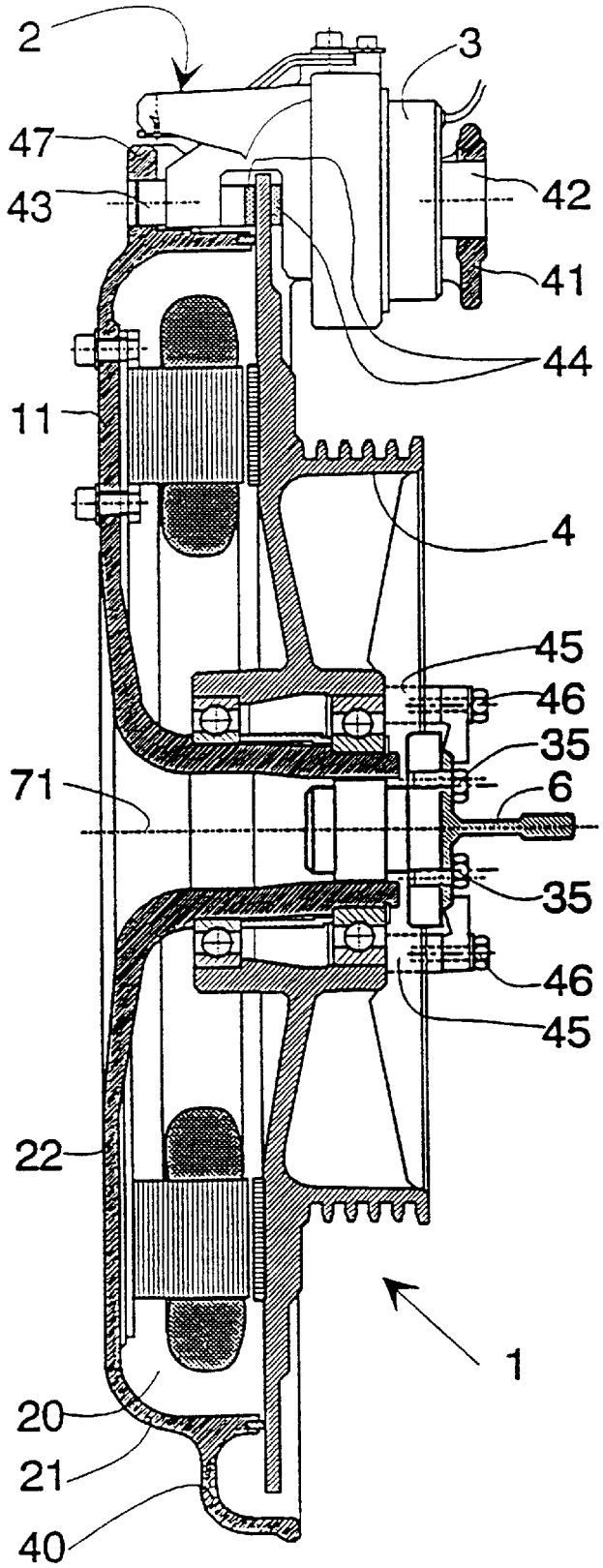
FIG. 3 presents another cross-section of the elevator machinery.

FIG. 3 presents section III—III of FIG. 1. The machinery has two brakes 3 float-mounted by means of clamps 42 and 43 between mounting brackets 47 forming an extension of the stator disc 11 and a bar 41 attached to the stator disc. The brake has braking surfaces 44 placed on either side of the brake disc. The figure also shows the lugs 45 forming an extension of the top circle of the stator disc on opposite sides of the stator disc in the direction of the guide rail which are directed towards the guide rail and by which the elevator machinery is fastened to the guide rail by means of fixing elements 46.

Figure 4:
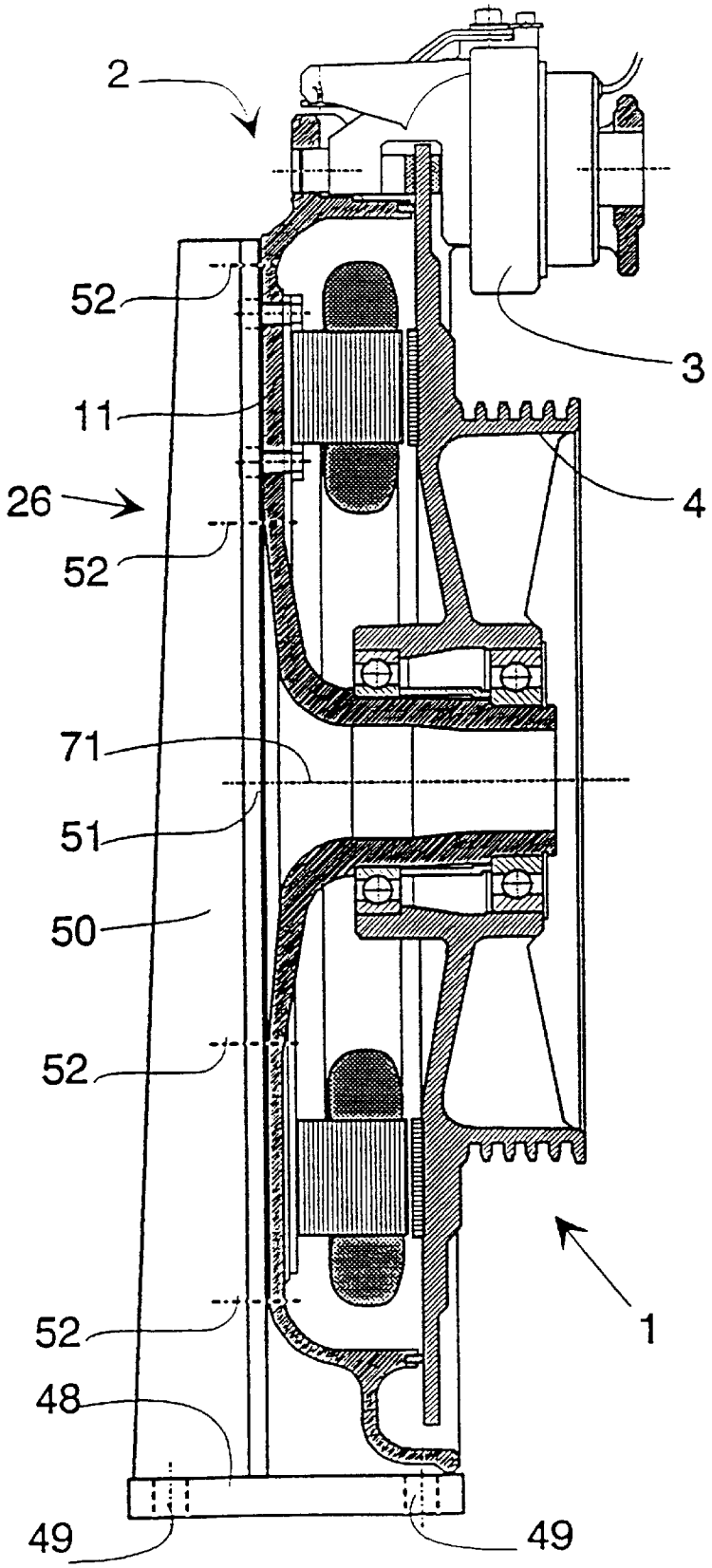
FIG. 4 presents an elevator machinery mounted on a support.

FIG. 4 presents ail elevator machinery 1 according to the invention which comprises a supporter 26 attached to the stator disc 11 to permit the elevator machinery 1 to be fixed in the place of installation, e.g. in an elevator machine room. The supporter 26 consists of a platelike base 48, placed horizontally in the figure and provided with mounting holes 49 allowing the machinery to be fastened in the place of installation. Attached to the base is a bracket 50 for holding the machinery upright and a supporting plate 51 joined to the bracket 50 at right angles. The elevator machinery is fixed by its stator disc to the supporting plate by means of fixing elements, preferably screws. The elevator machinery of the invention can also be fixed to any other straight plate, such as a side plate of the counter-weight or even to a wall of the elevator shaft.

It is obvious to a person skilled in the art that the embodiments of the invention are not restricted to the examples described above, but that they may instead be varied within the scope of the claims presented below.

We claim:

1. Elevator machinery comprising:

an elevator motor; and a traction sheave for driving elevator ropes and, said elevator motor including a stator, a shaft and rotor, and a bearing between the rotor and stator, said stator including a stator disc with stator windings, said rotor including a rotor disc provided with a rotor excitation system attached to the rotor disc in an area opposite to the stator windings, with an air gap between said excitation system and the stator windings, the air gap forming a plane substantially perpendicular to the shaft, said traction sheave and said stator being placed on different sides of the rotor disc in the direction of the shaft of the elevator motor and in which elevator machinery the outermost diameter of the stator winding is larger than the diameter of the traction sheave as measured in the area of the ropes, and further wherein the excitation system has a plurality of permanent magnets attached to the rotor disc so as to form a ring-shaped circle, and wherein the rotor disc forms part of the magnetic circuit.

2. The elevator machinery according to claim 1, wherein, outside the circle formed by the permanent magnets, the rotor disc has at least one annular braking surface having an outermost extension of the rotor disc.

3. The elevator machinery according to claim 1, wherein the stator disc has a cuplike or ring-shaped annular cavity open on one side and formed by a first wall and a second wall joined together, the first wall being attached to the shaft, and the stator with the stator winding being attached to the first wall, said second wall being directed towards the rotor disc.

4. The elevator machinery according to claim 1, wherein the stator disc has a cup-like or ring-shaped annular cavity open on one side and formed by a first wall and a second wall joined together, both walls being directed towards the rotor disc, the first wall being attached to the shaft by bracing ribs, and the stator with the stator winding being attached either to the first or the second wall.

5. elevator machinery according to claim 1, wherein the traction sheave is integrated with the rotor disc so as to form a single body.

6. The elevator machinery according claim 1, wherein the shaft is integrated with the stator disc so as to form a single body.

7. The elevator machinery according to claim 1, wherein the shaft is a hollow structure.

8. The elevator machinery according to claim 1, wherein a sealing is provided between the rotor disc and the stator disc outside of the circle.

9. The elevator machinery according to claim 8, wherein the sealing is a labyrinth seal.

10. The elevator machinery according to claim 1, wherein the shaft is integrated with the stator disc so as to form a single part, and the bearing is placed between the rotor disc and the stator disc.

11. The elevator machinery according to claim 1, further comprising fixing elements for fixing the elevator machinery to a guide rail of the elevator system.

12. The elevator machinery according to claim 11, wherein said stator disc includes an outer wall distal from the shaft and extending toward the rotor disc, said fixing elements being located at an end of the outer wall.

13. The elevator machinery according to claim 11, wherein said fixing elements connect the shaft of the motor to a guide rail of an elevator car or of a counterweight.

14. The elevator machinery according to claim 11, wherein said fixing elements are arranged such that, when fixed to the guide rail, the guide rail intersects the mid-line of the motor shaft.

15. The elevator machinery according to claim 1, wherein said traction sheave and said stator are placed directly opposite one another on opposite sides of the rotor disc, as considered along the shaft of the elevator motor.

16. The elevator machinery according to claim 1, wherein said stator consists of the stator disc having a stator core packet of stampings with stator windings, and said rotor consists of the rotor disc provided with the rotor excitation system.

17. The elevator machinery according to claim 1, wherein said stator disc includes a stator core packet of stampings with said stator windings.

18. The elevator machinery comprising:

an elevator motor; and a traction sheave for driving elevator ropes;

said elevator motor including a stator, a shaft, a rotor, and a bearing between said rotor and said stator, said stator including a stator disc having stator windings, said rotor including a rotor disc provided with a rotor excitation system attached to the rotor disc in an area opposite to the stator windings, with an air gap between said excitation system and the stator windings, said air gap having a conical shape.

19. The elevator machinery according to claim 18, wherein the outermost diameter of the stator winding is larger than the diameter of the traction sheave as measured in the area of the ropes.

20. The elevator machinery according to claim 18, wherein the traction sheave is integrated with the rotor disc so as to form a single body.

21. The elevator machinery according to claim 18, wherein the shaft is integrated with the stator disc so as to form a single body.

22. The elevator machinery according to claim 18, wherein the shaft is a hollow structure.

23. The elevator machinery according to claim 18, wherein the stator disc has an annular cavity open on one side and formed by a first wall and a second wall connected to one another, wherein the first wall is attached to the shaft and the second wall is directed toward the rotor disc.

24. The elevator machinery according to claim 23, wherein the stator includes a stator core packet attached to the first wall.

25. The elevator machinery according to claim 23, wherein the first wall is generally perpendicular to the shaft of the motor.

26. The elevator machinery according to claim 23, further comprising a sealing provided between the rotor disc and the second wall.

27. The elevator machinery according to claim 26, wherein the sealing is a labyrinth seal.

28. The elevator machinery according to claim 18, wherein the stator disc includes an outer wall distal from the shaft, the outer wall forming an annular cavity open toward the rotor disc.

29. The elevator machinery according to claim 28, wherein the outer wall is attached to the shaft by bracing ribs.

30. The elevator machinery according to claim 28, further comprising a sealing provided between the rotor disc and the outer wall.

31. The elevator machinery according to claim 30, wherein the sealing is a labyrinth seal.

32. The elevator machinery according to claim 18, wherein the excitation system includes of a plurality of permanent magnets attached to the rotor disc so as to form a ring-shaped circle, and further wherein the rotor disc forms part of the magnetic circuit.

33. The elevator machinery according to claim 18, wherein the rotor disc includes at least one annular braking surface at an outermost extension of the disc.

34. The elevator machinery according to claim 33, wherein the excitation system includes of a plurality of permanent magnets attached to the rotor disc so as to form a ring-shaped circle, the annular braking surface being outside the circle.

35. The elevator machinery according to claim 18, wherein the stator disc has an annular cavity open on one side and formed by a first wall and a second wall joined together, the first wall being attached to the shaft, and the stator core packet being attached to the first wall, said second wall being directed toward the rotor disc.

36. The elevator machinery according to claim 18, wherein the stator disc has an annular cavity open on one side and formed by a first wall and a second wall joined together, both walls being directed toward the rotor disc, the first wall being attached to the shaft, and the stator core packet being attached either to the first or the second wall.

37. The elevator machinery according to claim 18, wherein the shaft is integrated with the stator disc so as to form a single part.

38. The elevator machinery according to claim 37, wherein the bearing is placed between the rotor disc and the stator disc.

39. The elevator machinery according to claim 18, further comprising a supporter attached to the stator disc, the elevator machinery being fixed in a place of installation by said supporter.

40. The elevator machinery according to claim 18, further comprising fixing elements for fixing the elevator machinery to a guide rail of the elevator system.

41. The elevator machinery according to claim 40, wherein the stator disc includes an outer wall distal from the shaft and extending toward the rotor disc, said fixing elements being located at an end of the outer wall.

42. The elevator machinery according to claim 40, wherein said fixing elements connect the shaft of the motor to a guide rail of an elevator car or of a counterweight.

43. The elevator machinery according to claim 40, wherein said fixing elements are arranged such that, when fixed to the guide rail, the guide rail intersects the mid-line of the motor shaft.

44. The elevator machinery according to claim 18, wherein said stator consists of the stator disc having the stator core packet of stampings with stator windings, and said rotor consists of the rotor disc provided with the rotor excitation system.

45. The elevator machinery according to claim 18, wherein the cone has a mid-line defining an axis of rotation, the axis of rotation coinciding with a mid-line of said shaft.

46. The elevator machinery according to claim 18, wherein said traction sheave and said stator are placed directly opposite one another on opposite sides of the rotor disc, as considered along the shaft of the elevator motor.

* * * * *